US008141548B2

(12) United States Patent
Leven

(10) Patent No.: US 8,141,548 B2
(45) Date of Patent: Mar. 27, 2012

(54) OSCILLATION TRANSFER PLATE FOR DAMPENING NOISE AND VIBRATION

(75) Inventor: William L. Leven, Canoga Park, CA (US)

(73) Assignee: Leven Industries, Lancaster, CA (US)

( * ) Notice: Subject to any disclaimer, the term of this patent is extended or adjusted under 35 U.S.C. 154(b) by 984 days.

(21) Appl. No.: 11/646,831

(22) Filed: Dec. 28, 2006

(65) Prior Publication Data

US 2008/0156310 A1 Jul. 3, 2008

(51) Int. Cl.
*F41B 5/20* (2006.01)

(52) U.S. Cl. ..... 124/89; 267/136; 267/141

(58) Field of Classification Search ..... 124/89; 267/136, 137, 139, 140, 141; 15/424, 425
See application file for complete search history.

(56) References Cited

U.S. PATENT DOCUMENTS

| | | | | | |
|---|---|---|---|---|---|
| 775,616 | A * | 11/1904 | Warren | 15/425 |
| 2,076,019 | A * | 4/1937 | Fifield | 238/283 |
| 2,363,064 | A * | 11/1944 | Israel | 15/425 |
| 2,685,269 | A * | 8/1954 | Manson | 114/219 |
| 2,873,109 | A * | 2/1959 | Hartenstein et al. | 267/165 |
| 3,014,710 | A * | 12/1961 | Layne | 267/140 |
| 3,093,367 | A * | 6/1963 | Hawkins et al. | 267/153 |
| 3,418,815 | A * | 12/1968 | Kumazawa | 405/215 |
| 3,507,123 | A * | 4/1970 | Misao | 405/215 |
| 3,933,387 | A * | 1/1976 | Salloum et al. | 293/120 |
| 4,050,689 | A * | 9/1977 | Barton et al. | 293/110 |
| 4,072,334 | A * | 2/1978 | Seegmiller et al. | 293/110 |
| 4,811,947 | A * | 3/1989 | Takatsuka et al. | 473/523 |
| 4,822,011 | A * | 4/1989 | Goldbach et al. | 267/201 |
| 5,183,264 | A * | 2/1993 | Lanctot | 473/520 |
| 5,201,489 | A * | 4/1993 | Wolf et al. | 248/638 |
| 5,273,022 | A | 12/1993 | Leven | |
| 5,362,046 | A | 11/1994 | Sims | |
| 5,570,739 | A | 11/1996 | Krawchuk et al. | |
| 5,580,032 | A * | 12/1996 | Gustafsson | 267/64.27 |
| 5,584,282 | A | 12/1996 | McDonald, Jr. | |
| 5,595,168 | A * | 1/1997 | Martin | 124/89 |
| 5,615,664 | A | 4/1997 | McDonald, Jr. | |
| 5,772,541 | A * | 6/1998 | Buiatti | 473/520 |
| 6,085,736 | A | 7/2000 | Osterhues | |
| D436,643 | S | 1/2001 | Sims | |
| D445,161 | S | 7/2001 | Sims | |
| 6,298,842 | B1 | 10/2001 | Sims | |
| 6,382,201 | B1 | 5/2002 | McPherson et al. | |
| D469,839 | S | 2/2003 | Gibbs | |
| 6,540,216 | B2 * | 4/2003 | Tousi et al. | 467/140.3 |
| 6,684,874 | B2 * | 2/2004 | Mizek et al. | 124/89 |
| 6,712,059 | B2 * | 3/2004 | Donovan | 124/89 |
| 6,745,757 | B2 * | 6/2004 | Sims | 124/89 |
| 6,758,205 | B2 * | 7/2004 | Kronfeld | 124/89 |
| 7,263,806 | B2 * | 9/2007 | Pellegrino et al. | 52/167.8 |
| 2002/0043747 | A1 * | 4/2002 | Vismara | 267/136 |
| 2006/0061027 | A1 * | 3/2006 | Landi | 267/195 |

* cited by examiner

*Primary Examiner* — John Ricci
(74) *Attorney, Agent, or Firm* — DLA Piper LLP (US)

(57) ABSTRACT

A vibration dampener including an elastomeric body having a top and bottom surface and a vibration transfer plate provided on the top surface of the elastomeric body. The bottom surface of the elastomeric body can be provided with a mounting base and is for being mounted to an object to be vibration controlled.

6 Claims, 2 Drawing Sheets

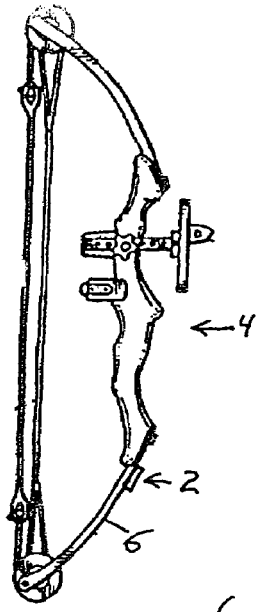
Fig. 1
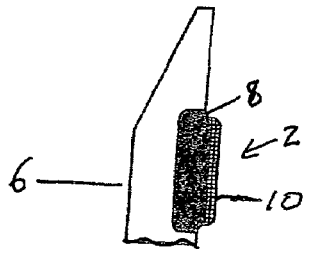
Fig. 2
Fig. 4
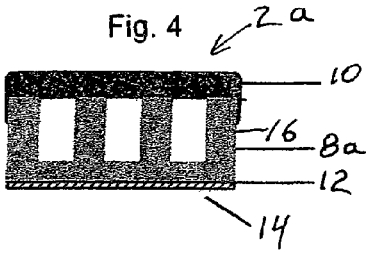
Fig. 5
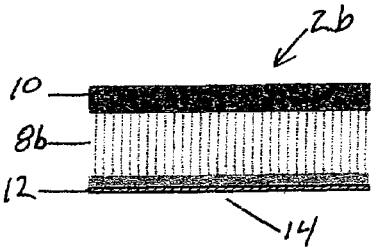
Fig. 6
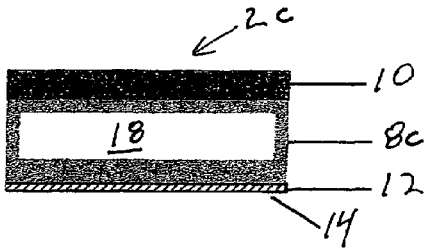
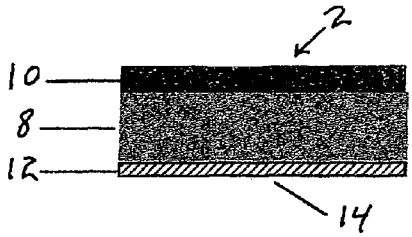
Fig. 3

Fig. 7
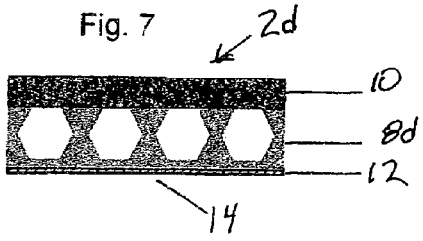
Fig. 8
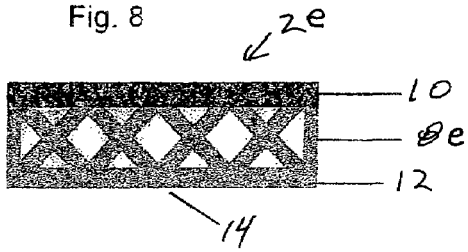
Fig. 9
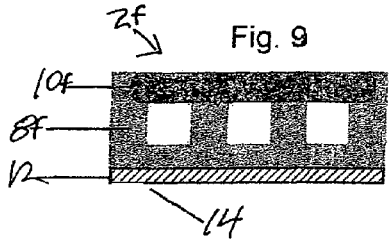
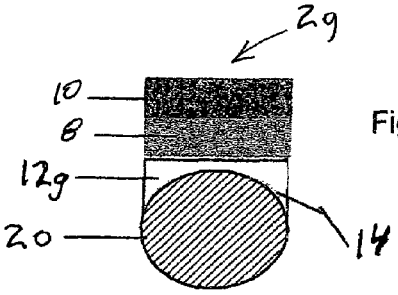
Fig. 10
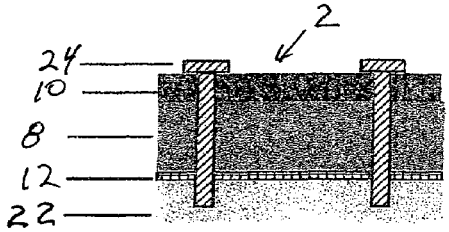
Fig. 11
Fig. 12
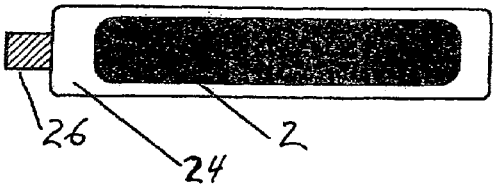
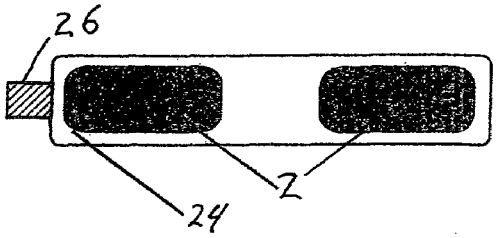
Fig. 13

OSCILLATION TRANSFER PLATE FOR DAMPENING NOISE AND VIBRATION

BACKGROUND OF THE INVENTION

1. Field of the Invention

The present invention relates a vibration damper which attaches to a surface of an object to dissipate the noise and vibration generated in an object.

2. Prior Art

There are several devices in the prior art designed to help to eliminate vibration and noise in an object. Such devices are shown in U.S. Pat. Nos. 5,273,022; 5,362,046; 5,615,664; 5,570,730; 5,584,282; 6,085,736; 6,298,842; and 6,382,201 and U.S. Design Pat. D436,643; D445,161; and D469,839.

The devices in the above listed patents and designs all contain a weight, a mushroom shaped head or an internal wiggling, dampening or metallic spacer to separate the vibrating body apart from the member that the vibration is transferred to. As a result, these devices all stick out from the body that is vibrating and generally have an unaesthetic appearance. Still further, such devices do not conform to the general shape of the object which is vibrating and are of an appropriate length or depth to cause an unobjectionable protruding from the object. In addition, such vibrating devices typically only transfer the vibration from a single point or area which is relatively small in size.

SUMMARY OF THE INVENTION

Accordingly, it is the general object of the present invention to overcome the disadvantages of the prior art.

In particular, it is an object of the present invention to provide a vibration and noise dampener which does not protrude objectionably from the object which is vibrating, can be formed in an aesthetic shape and can be formed to fit the general shape of the object which is vibrating.

The above objects of the present invention are accomplished by an unique vibration noise dampener including an elastomer body having a top and a bottom surface, a vibration transfer plate provided on the top surface of the elastomer body, a mounting base provided on the bottom surface of the elastomer body and a means for coupling the vibration dampener to the object which vibrates. In some constructions, the mounting base can be eliminated and the bottom surface of the elastomer body may be applied and directly coupled to the object which vibrates utilizing a means such as an adhesive, double-sided tape, etc.

BRIEF DESCRIPTION OF THE DRAWINGS

The above-mentioned features and objects of the present invention, as well as other features and objections of the present invention, will become more apparent with reference to the following description taken together with the accompanying drawings wherein like reference numerals denote like elements and in which:

FIG. 1 is a side view of an archery bow with a vibration dampener of the present invention attached thereto;

FIG. 2 is an enlarged portion of FIG. 1 illustrating the attachment of the dampening member of the present invention;

FIG. 3 is a first embodiment of the present invention;

FIG. 4 is a second embodiment of the present invention;

FIG. 5 is a third embodiment of the present invention;

FIG. 6 is a fourth embodiment of the present invention;

FIG. 7 is a fifth embodiment of the present invention;

FIG. 8 is a sixth embodiment of the present invention;

FIG. 9 is a seventh embodiment of the present invention;

FIG. 10 illustrates the attachment of the present invention to an object which does not present a flat surface;

FIG. 11 illustrates a mounting for the present invention;

FIG. 12 illustrates the present invention applied to a bow stabilizer; and

FIG. 13 is a second illustration of the utilization of the present invention on a bow stabilizer.

DETAILED DESCRIPTION OF THE INVENTION

Referring to FIGS. 1, 2 and 3, shown in FIG. 1 is a bow 4 with a vibration dampener 2 of the present invention which is shown in FIG. 3 attached to a limb 6 of the bow 4. FIG. 2 is an enlarged fragmentary portion of the FIG. 1 illustrating the vibration dampener 2 attached to the limb 6.

As shown in FIG. 3, the vibration dampener 2 comprises an elastomeric body 8 with a plate 10 provided on one surface thereof and a mounting base 12 provided on the other surface thereof. The mounting base 12 is further provided with a means 14 for mounting the vibration dampener 2 to the limb 6 of the bow 4. This mounting means 14 can comprise an adhesive or double-sided tape. In some instances and for some applications, the base 12 may be eliminated completely and one surface of the elastomeric body 8 may be directly connected to the limb 6 by mounting means 14. It should be apparent that in this instance, since limbs are relatively flat, the vibration dampener 2 presents a flat shape so as to conform to the limb 6. Also, it should be apparent that the vibration dampener 2 does not project far from the surface of the limb and therefore provides a pleasing appearance.

In use, when an arrow is launched from the bow 4, vibration is generated in the bow 4 and particularly transmitted through the limbs 6 and absorbed by the elastomeric body 8 and the movement of the plate 10. The mass of the plate 10 and the softness or flexibility of the elastomeric body can be adjusted or set so that the vibration dampener 2 absorbs the vibration generated by the body to which it is applied in the most efficient manner. Typically, the plate 10 will have substantial specific gravity and they will be made from materials such as metals, rubber or plastics impregnated with heavy materials such as metal filings, etc. Still further, the flexibility or softness of the elastomeric body 8 is typically in the range of 5 to upwards of 30 Duro meters and can be made from materials such as rubber, sponge, synthetic rubbers, other known energy absorbing materials, etc. Still further, in some applications, the elastomeric body 8 might be made from two or more different materials laminated one on top of the other and/or one next to the other and the plate 10 could be made from two or more dissimilar materials bonded together.

While the vibration dampener 2 of FIG. 3 is shown utilizing an elastomeric body 8 which is solid, it would be also possible to make the vibration dampener with other configurations. The other configurations are shown in FIGS. 4-9. In FIG. 4, the vibration dampener 2*a* includes an elastomeric body 8*a* which includes upwardly extending fingers 16 with spaces in between so as to allow the plate 10 to vibrate more freely in use.

In FIG. 5 is shown a vibration dampener 2*b* wherein the elastomeric body 8*b* comprises a combed body section which can be either made by providing a plurality of small teeth or by providing a plurality of slits through the elastomeric body 2*b*. Such a construction allows the vibration dampener 2*b* to respond to higher frequency vibrations.

Referring to FIG. 6, shown therein is another vibration dampener 2*c* wherein a large hollow air space 18 is provided within the elastomeric body 8*c*. Such a construction allows the plate 10 to ride on an air cushion.

Referring to FIG. 7, shown therein is a vibration dampener 2*d* wherein the elastomeric body 8*d* is provided with a honeycombed structure in order to allow for compression of heavier plates 10. Such a structure would be suitable for absorbing low frequency vibrations.

Referring to FIG. 8, shown there is a vibration dampener 2*e* wherein the elastomeric body 8*e* is provided with cross membered portions. Such a construction shown in FIG. 8 allows for the support of the still heavier vibration plates.

Referring to FIG. 9, shown therein is a vibration dampener 2*f* which is similar to that of the vibration dampener 2*a* of FIG. 4. However, in this construction, the plate 10*f* is provided shorter in length than the elastomeric body 8*f* and portions of the elastomeric body cover all of the edges of the plate 10*f*. With this construction of FIG. 9, the plate 10*f* is recessed into the elastomeric body 8*f* and the elastomeric body 8*f* protects the side of the plate 10*f* and isolates it from contact with other objects.

Referring to FIG. 10, shown therein is a vibration dampener 2*g* wherein the plate 10 and elastomeric body 8 are of any shape construction shown in the FIGS. 3-9. However, in this construction, in order to mount the vibration dampener 2*g* to an irregularly shaped body 20, the mounting base 12*g* is formed so that it can conform to the shape of the irregularly shaped body 20. However, it would be possible to make the vibration dampener 2*g* in such a way that all of the components thereof conform to the shape of the irregularly shaped body 20. In other words, the plate 10, elastomeric body 8 and mounting base 12*g* could all be curved or formed so as to be mountable and mounted to conform to the surface of the irregularly shaped body 20.

Referring to FIG. 11, shown therein is another means for mounting the vibration dampener 2 to a body 22. In this constructions, screws are utilized and inserted through holes in the vibration dampener 2 and screwed into the body 22.

Referring to FIGS. 12 and 13, shown therein are the vibration dampener 2 of the present invention applied to a stabilizer 24 which could be utilized together with a bow such as bow 4 of FIG. 1. The stabilizer 24 includes a threaded portion 26 which screws into a corresponding portion of the bow 4. In this construction, one or two or more vibration dampeners 2 could be applied to the stabilizer 24.

While the vibration dampener of the present invention has been described in terms of utilization with a bow, it could be utilized with other devices and provided on both inside and outside surfaces thereof. Such other devices would include firearms, other sporting goods, automotive products, musical instruments, industrial machines, etc.

It should be apparent to those skilled in the art that the above described embodiments are merely illustrative of but a few of the many possible embodiments of the present invention which could be created by one of ordinary skill in the art without departing from the spirit and scope of the present invention.

I claim:

1. A vibration dampener for an archery bow consisting of:

an elastomeric body having a top and bottom surface, said bottom surface for coupling said vibration dampener to an archery bow to be vibration controlled; and a vibration transfer plate of substantially the same size as said elastomeric body provided only on said top surface of said elastomeric body; wherein said bottom of said elastomeric body of said vibration dampener to be coupled to said archery bow is provided with one or more selected from the group consisting of double sided tape and adhesive;

whereby noise and vibration in said archery bow can be dissipated.

2. A vibration dampener according to claim 1, wherein the vibration dampener has a shape conforming to a shape of said archery bow.

3. A vibration dampener according to claim 1, wherein said elastomeric body is solid.

4. A vibration dampener according to claim 1, wherein said vibration dampener is for being coupled to a stabilizer of said archery bow.

5. A vibration dampener according to claim 1, wherein a flexibility of said elastomeric body is 5 to 30 Durometers.

6. The vibration dampener according to claim 1, wherein said vibration dampener is for being coupled to a limb of said archery bow.

* * * * *